US011083973B2

(12) United States Patent
Egli et al.

(10) Patent No.: US 11,083,973 B2
(45) Date of Patent: Aug. 10, 2021

(54) VEHICLE HOPPING SYSTEM

(71) Applicant: Namero, LLC, Phoenix, AZ (US)

(72) Inventors: Alaric R. Egli, Gilbert, AZ (US); Matthew R. Jackson, Gilbert, AZ (US); Darin Oreman, Tempe, AZ (US); Jeroen de Vries, Almere (NL)

(73) Assignee: Namero, LLC, Phoenix, AZ (US)

( * ) Notice: Subject to any disclaimer, the term of this patent is extended or adjusted under 35 U.S.C. 154(b) by 39 days.

(21) Appl. No.: 16/181,223

(22) Filed: Nov. 5, 2018

(65) Prior Publication Data

US 2019/0134520 A1 May 9, 2019

Related U.S. Application Data

(60) Provisional application No. 62/584,038, filed on Nov. 9, 2017.

(51) Int. Cl.
*A63H 17/26* (2006.01)

(52) U.S. Cl.
CPC ..... *A63H 17/262* (2013.01)

(58) Field of Classification Search
CPC .... A63H 17/262; A63H 17/004; A63H 17/36; A63H 33/005; B60G 2500/30; B60G 15/00; B60G 15/062; B60G 15/067; B60G 2204/128; B60G 2204/129; B60G 2204/13
See application file for complete search history.

(56) References Cited

U.S. PATENT DOCUMENTS 2,152,938 A * 4/1939 Welch ..... B60G 21/05 280/124.103
4,650,213 A * 3/1987 Fujita ..... B62D 9/02 280/124.103
4,696,655 A 9/1987 D'Andrade et al.
4,958,584 A * 9/1990 Williamson ..... B60F 3/00 280/6.157
5,048,860 A * 9/1991 Kanai ..... B60G 3/205 280/124.138
5,080,389 A * 1/1992 Kawano ..... B60G 3/20 280/124.142
5,334,077 A 8/1994 Bailey
5,458,359 A * 10/1995 Brandt ..... B60G 9/00 180/349
5,590,617 A * 1/1997 Gere ..... B60F 3/0007 440/12.51
5,722,872 A 3/1998 Simmons et al.
(Continued)

FOREIGN PATENT DOCUMENTS

GB 2354984 A * 4/2001 ..... B60G 21/04

OTHER PUBLICATIONS

Youtube. Wicked '67 RC Lowrider by Jervies . . . Video, https://www.youtube.com/watch?v—N8EQLClegqs, published Jan. 1, 2016.
(Continued)

*Primary Examiner* — Melba Bumgarner
*Assistant Examiner* — Amir A Klayman
(74) *Attorney, Agent, or Firm* — Craig R. Miles; CR Miles P.C.

(57) ABSTRACT

A toy vehicle suspension operable to lift and lower the vehicle chassis of the toy vehicle. In particular embodiments, the vehicle suspension transmits sufficient forces to the wheels of the toy vehicle to enable the wheels to hop off the ground.

15 Claims, 5 Drawing Sheets

(56) References Cited

U.S. PATENT DOCUMENTS 5,785,576 A 7/1998 Belton
6,015,330 A 1/2000 Simmons et al.
6,036,575 A 3/2000 Rehkemper et al.
6,182,979 B1 * 2/2001 Lee ..... B60G 3/20 280/5.507
6,357,268 B1 * 3/2002 Takimoto ..... E05B 17/0025 70/208
6,383,054 B1 5/2002 Rauch
6,510,917 B2 * 1/2003 Cole ..... B62D 5/0418 180/436
6,530,586 B2 * 3/2003 Fader ..... B60G 21/0556 280/124.106
6,547,260 B2 * 4/2003 Laurent ..... B60G 3/01 280/124.103
6,620,023 B2 9/2003 Yeung
6,637,758 B2 * 10/2003 Woo ..... B60G 3/26 280/5.521
6,679,752 B1 1/2004 Reed, Sr.
6,719,313 B2 * 4/2004 Zadok ..... B60G 15/063 280/124.103
6,758,719 B1 7/2004 Nava
6,767,272 B2 7/2004 Santarsiero
6,793,228 B2 * 9/2004 Zadok ..... B60G 3/06 280/124.134
6,945,843 B1 * 9/2005 Motosko ..... A63H 17/262 446/437
7,063,179 B2 * 6/2006 Takayanagi ..... B62K 5/027 180/210
7,278,511 B1 * 10/2007 Gass ..... B62D 7/1509 180/409
7,343,997 B1 * 3/2008 Matthies ..... B60G 21/007 180/215
7,407,173 B2 * 8/2008 Walker ..... B60G 21/05 280/124.134
7,530,419 B2 * 5/2009 Brudeli ..... B60G 21/007 180/210
7,665,742 B2 * 2/2010 Haerr ..... B62K 5/027 280/5.508
7,749,047 B2 7/2010 Dunham
7,887,074 B2 2/2011 Byers et al.
7,914,025 B2 * 3/2011 Mayen ..... B60G 3/20 280/124.109
7,922,184 B2 * 4/2011 Porcheron ..... A61G 5/046 280/93.506
8,128,110 B2 * 3/2012 Sacli ..... B60G 21/05 280/124.106
8,302,728 B1 11/2012 Dotson
8,380,394 B1 * 2/2013 Snodgrass ..... B60G 17/018 280/5.507
8,480,106 B1 * 7/2013 Cohen ..... B60G 17/005 280/124.125
8,641,064 B2 * 2/2014 Krajekian ..... B62K 5/05 280/124.103
8,662,228 B2 * 3/2014 Hill ..... B62K 5/05 180/210
8,764,040 B1 * 7/2014 DeLauter ..... B60G 3/20 280/124.135
8,925,940 B2 * 1/2015 Mighell ..... B60G 21/007 280/124.103
9,096,261 B2 * 8/2015 Aldrich ..... B62D 7/20
9,120,511 B1 * 9/2015 Beard ..... A63H 17/36
9,527,543 B2 * 12/2016 Mercier ..... B60G 15/062
2002/0077026 A1 6/2002 Li
2003/0116935 A1 * 6/2003 Zadok ..... B60G 21/05 280/124.106
2003/0164603 A1 9/2003 Zadok
2005/0275181 A1 * 12/2005 MacIsaac ..... B60G 3/01 280/124.103
2006/0172628 A1 * 8/2006 Longdill ..... B60F 3/0007 440/12.5
2007/0075517 A1 * 4/2007 Suhre ..... B60G 3/20 280/124.134
2007/0182120 A1 * 8/2007 Tonoli ..... B60G 21/007 280/124.142
2008/0197597 A1 * 8/2008 Moulene ..... B62D 21/183 280/124.103
2009/0256326 A1 10/2009 Sacli
2010/0164189 A1 * 7/2010 Buma ..... B60G 17/0161 280/5.521
2011/0048833 A1 * 3/2011 Schapf ..... B60G 3/20 180/233
2013/0062133 A1 * 3/2013 Budweil ..... B62D 7/14 180/209
2013/0241168 A1 9/2013 Michel
2014/0227941 A1 * 8/2014 Suzuki ..... A63H 30/04 446/456
2014/0306415 A1 * 10/2014 Aldrich ..... B62D 7/20 280/124.116
2014/0312580 A1 * 10/2014 Gale ..... B62D 9/02 280/5.509
2014/0346753 A1 * 11/2014 Huang ..... B62D 9/04 280/269
2016/0016451 A1 1/2016 Izak
2016/0075200 A1 * 3/2016 Hansen ..... B60K 7/0007 180/55
2016/0159180 A1 * 6/2016 Palatov ..... B60G 3/26 280/5.507
2017/0057351 A1 * 3/2017 Bandy ..... B60K 5/02
2019/0144035 A1 * 5/2019 Doerksen ..... B60G 17/0162 280/124.103

OTHER PUBLICATIONS

Youtube. BeSwitched '67 RC scale lowrider by Jevries. Video, https://www.youtube.com/watch?v=H4bGX9rdAjk, published Apr. 2, 2015.
Youtube. RC '64 Chevy Impala at the Tokyo lowrider show 2011. Video, https://www.youtube.com/watch?v—F3JYhSFtIX8, published May 17, 2013.
Youtube. Lowrider RC Homie Hopper. Video, https://www.youtube.com/watch?v=Bc094uOH6nU, published Apr. 18, 2012.
Youtube. Hopping Homie Hopper. Video, https://www.youtube.com/watch?v=23UvilkvNMI, published Jul. 30, 2009.
Youtube. All my Homie Hoppers plus a few more lowrider toys. Video, https://www.youtube.com/watch?v=CKayyZtimf4, published Nov. 20, 2015.
Youtube. Homie Hoppers Blvd Bouncer. Video, https://www.youtube.com/watch?v=kJFn1B31d3U, published Feb. 2, 2013.
Youtube. Lindberg Homie Hoppers '63 Impara 1:18 R/C. Video, https://www.youtube.com/watch?v=tY6ZakfpZiA, published Mar. 26, 2017.
Youtube. Homie Hopper. Video, https://www.youtube.com/watch?v=H2mMDfN8hGs, published Jul. 15, 2009.
Youtube. 1964 Chevrolet Impala Model Lowrider Dancer on Servos Hydraulics. Video, https://www.youtube.com/watch?v=yPfFpDZZAr8, published Sep. 25, 2014.
Youtube. Hopping Homies Hopper 2. Video, https://www.youtube.com/watch?v=e7YjwkJLTSk, published Sep. 14, 2009.
U.S. Appl. No. 62/584,038, filed Nov. 9, 2017.
PCT International Patent Application No. PCT/US18/59692; International Search Report and Written Opinion of the International Searching Authority dated Jan. 22, 2019, 14 pages.

* cited by examiner

VEHICLE HOPPING SYSTEM

This U.S. Non-Provisional Patent Application claims the benefit of U.S. Provisional Patent Application No. 62/584,038, filed Nov. 9, 2017, hereby incorporated by reference in the entirety herein.

FIELD OF THE INVENTION

A vehicle suspension operable to lift and lower the vehicle chassis of a toy vehicle. In particular embodiments, the vehicle suspension transmits sufficient force to the wheels of the toy vehicle to enable the wheels to hop off the ground.

SUMMARY OF THE INVENTION

A broad object of particular embodiments can be to provide a vehicle suspension apparatus including one or more of: a central bell crank pivotally mounted on a vehicle chassis to axially pivot along a longitudinal axis of the vehicle chassis; a first link having a first link end connected to a first bell crank pivotally mounted on the vehicle chassis to transversely pivot along a transverse axis across the longitudinal axis of the vehicle chassis and a second link end connected to the central bell crank; a second link adjacent to the first link and having a first link end connected to a second bell crank pivotally mounted on the vehicle chassis to transversely pivot along a transverse axis across the longitudinal axis of the vehicle chassis and a second link end connected to the central bell crank; and, a connecting rod pivotally connected at first end to the central bell crank and pivotally connected at a second end to a rotary actuator.

Another broad object of particular embodiments can be to provide a vehicle suspension apparatus including: a first adjustable-length member having a first mount connected to a first bell crank pivotally mounted on the vehicle chassis to transversely pivot along a transverse axis across the longitudinal axis of the vehicle chassis. A first vertical suspension assembly pivotally connected to the vehicle chassis interconnects a first wheel to a second mount of the first adjustable-length member.

Another broad object of particular embodiments can be to provide a vehicle suspension apparatus including: a second adjustable-length member having a first mount connected to a second bell crank pivotally mounted on the vehicle chassis to transversely pivot along a transverse axis across the longitudinal axis of the vehicle chassis. A second vertical suspension assembly pivotally connected to the vehicle chassis interconnects a second wheel to a second mount of the first adjustable-length member.

Another broad object of the invention can be to perform a method including one or more of: operating a rotary actuator to generate a pull force via a connecting rod connected to the rotary actuator; generating a radial force axially along a longitudinal axis of a vehicle chassis via a central bell crank connected to the connecting rod; transferring the radial force along a transverse axis across the longitudinal axis of the vehicle chassis via a first bell crank or a second bell crank linked to the central bell crank; and transmitting said radial force dispersed through the first bell crank or the second bell crank through corresponding first or second adjustable-length members to a first vertical suspension or a second vertical suspension assembly with sufficient force to enable the first or second wheel to hop off a support surface. In particular embodiments, the method can include concurrently transmitting said radial force dispersed through said first bell crank or said second bell crank through corresponding first and second adjustable-length members to a first vertical suspension and a second vertical suspension assembly with sufficient force to enable both first and second wheels to hop off the support surface.

Naturally, further objects of the invention are disclosed throughout other areas of the specification, drawings, photographs, and claims.

DETAILED DESCRIPTION OF THE INVENTION

Figure 1:
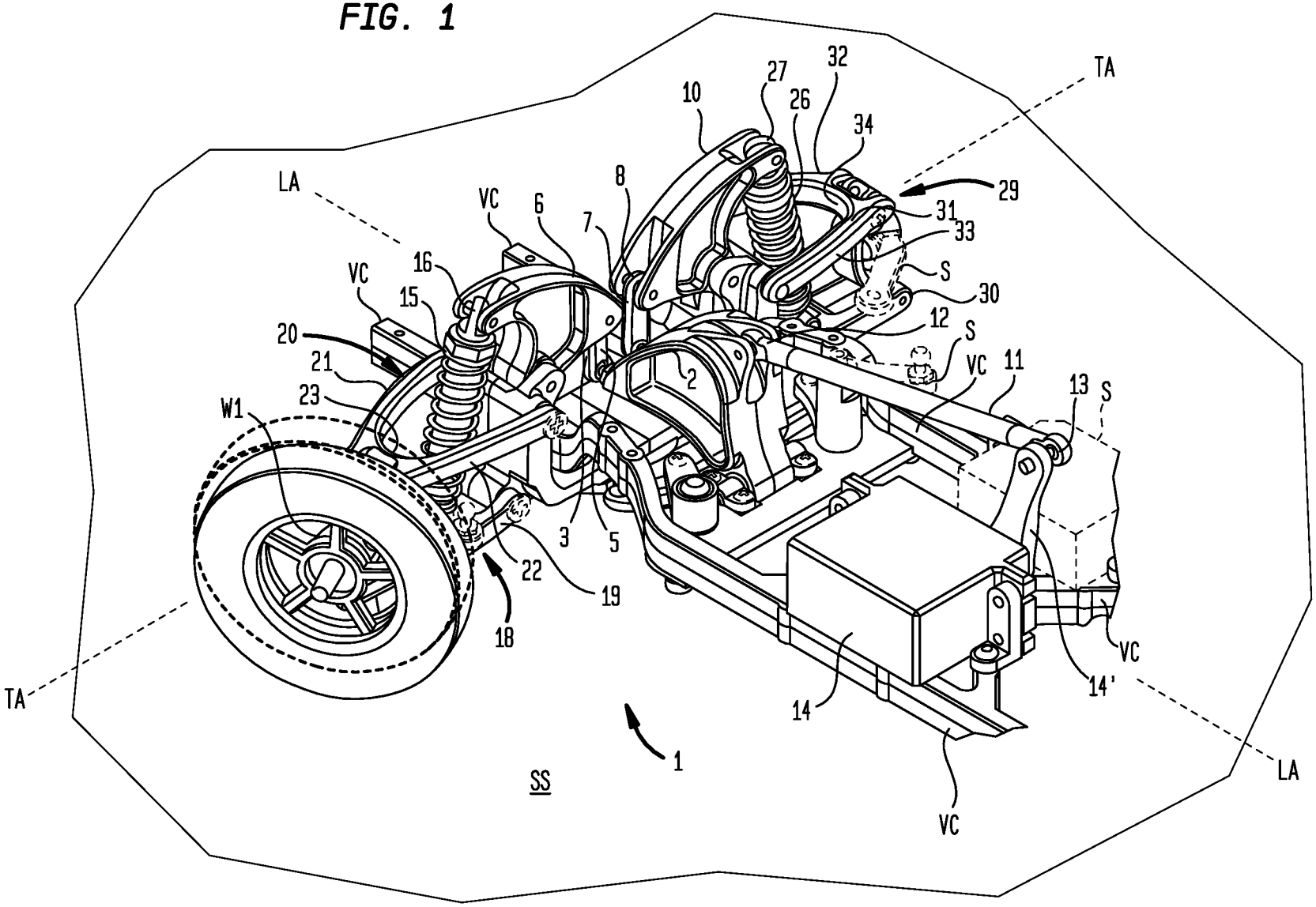
FIG. 1 is a top, left, perspective view of an embodiment of a vehicle suspension.

Generally, with reference to FIGS. 1 through 5 wherein like reference numerals denote like structure throughout the specification, embodiments of a vehicle suspension (1) include a central bell crank (2) pivotally mounted on a vehicle chassis (VC) to axially pivot along a longitudinal axis (LA) of the vehicle chassis (VC). A first bell crank (6) can be pivotally mounted on the vehicle chassis (VC) to transversely pivot along a transverse axis (TA) across the longitudinal axis (LA) of the vehicle chassis (VC). A first link (3) can have a first end (4) pivotally connected to the first bell crank (6) and can have a second end (5) pivotally connected to the central bell crank (2). In particular embodiments, a second bell crank (10) can be pivotally mounted on the vehicle chassis (VC) to transversely pivot along a transverse axis (TA) across the longitudinal axis (LA) of the vehicle chassis (VC). A second link (7) can have a first end (8) pivotally connected to the second bell crank (10) and a second end (9) pivotally connected to the central bell crank (2). A connecting rod (11) can be pivotally connected by a first end (12) to the central bell crank (2) and pivotally connected by a second end (13) to a rotary actuator (14). The rotary actuator (14) can include an actuator horn (14') connected to the second end (13) of the connecting rod (11).

In various embodiments, the central bell crank (2), the first bell crank (6), or the second bell crank (10) can be disposed in various structural forms capable of changing motion through an angle. The illustrative examples of the bell cranks (2) (6) or (10) shown in the Figures are not intended to preclude embodiments which incorporate similar or equivalent crank arms, crank levers, angled levers, suspension arms, or rocker arms, currently or prospectively available, and the fixed pivot or the moving pivots of the bell cranks (2) (6) or (10) can, but need not necessarily, further incorporate a bushing assembly or a bearing assembly to align, guide, or support the bell crank (2) (6) or (10) or reduce wear or friction. Further, while the illustrative examples may show pivot axes defined by pivot pins; this is not intended to preclude the use of pivot balls, pivot joints, ball joints, living hinges, or other structures which allow the fixed pivot or moving pivots of the bell cranks (2) (6) (10) to operate in relation to one another. Further, in various embodiments, the rotary actuator (14) can, but need not necessarily, be a commercially available servo motor used with toy and radio control vehicles. As an illustrative example, a servo motor suitable for use in embodiments can be a Redcat Racing Hexfly HX 15s 200 oz waterproof high torque metal gear servo available from Redcat Racing, 3145 East Washington Street, Phoenix, Ariz. 85034. However, this illustrative example of a rotary actuator (14) is not intended to preclude embodiments which incorporate similar or equivalent devices that produce rotary motion or torque, such as high speed and high torque servo motors, currently or prospectively available.

Again, referring primarily to FIGS. 1 through 5, in particular embodiments, the vehicle suspension (1) can further include a first adjustable-length member (15) having a first end mount (16) opposite a second end mount (17). The first adjustable-length member (15) connects to the first bell crank (6) at the first end mount (16). In particular embodiments, the first adjustable-length member (15) can, but need not necessarily, be a commercially available shock absorber or strut used in toy and radio control vehicles. As one illustrative example, an adjustable-length member (15) suitable for use in embodiments, can be a Redcat Racing Shock Absorber Part No. 86002 available from Redcat Racing, 3145 East Washington Street, Phoenix, Ariz. 85034. However, the illustrative examples of the first adjustable-length member (15) described in the specification or shown in the Figures are not intended to preclude embodiments which incorporate similar or equivalent toy vehicle shock absorbers, currently or prospectively available. In yet further embodiments, the first adjustable-length members (15) can, but need not necessarily, be a rigid linkage connected to torsion bars, or the like, in or for use with adjustable height suspensions.

Figure 2:
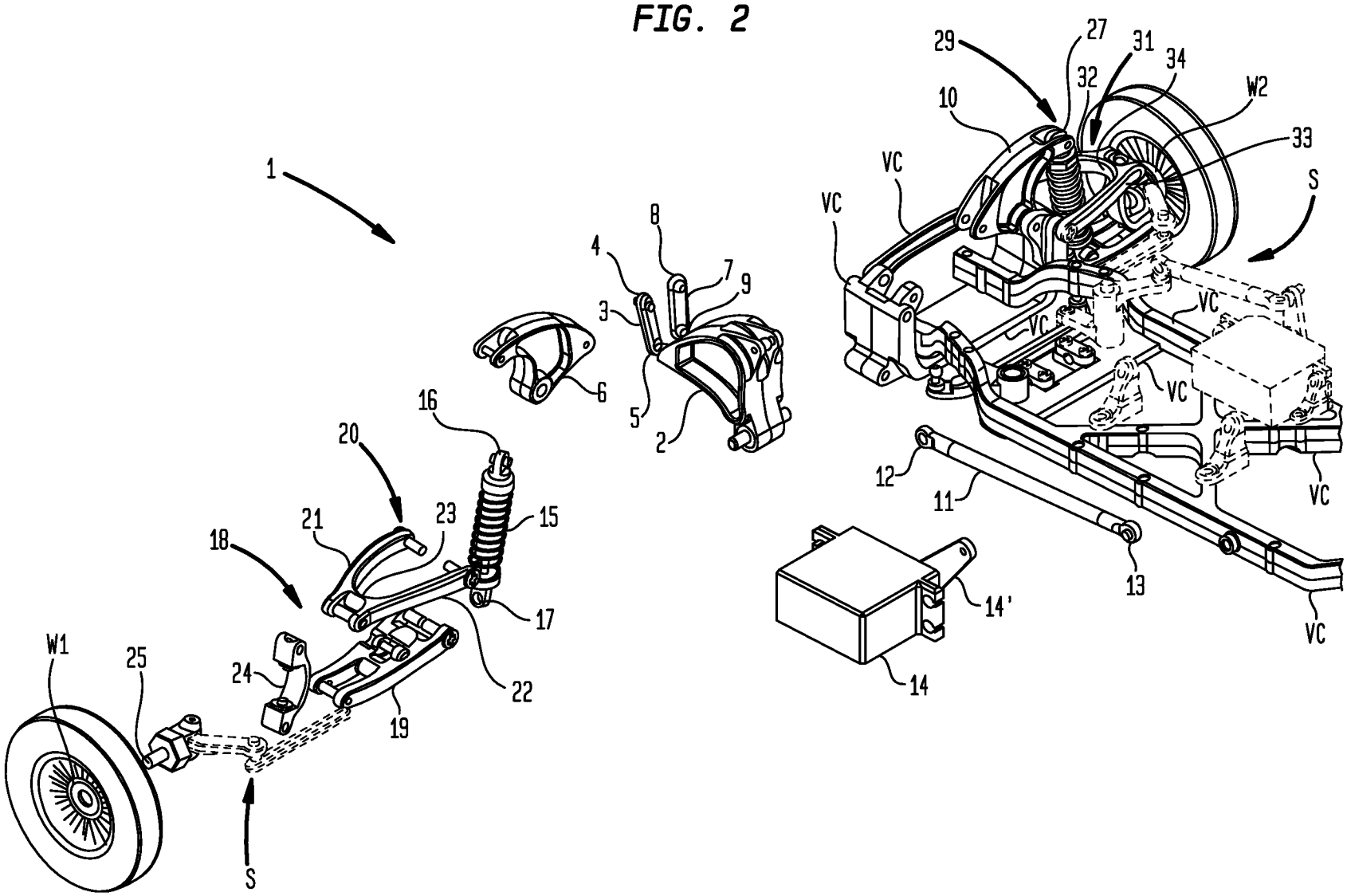
FIG. 2 is a partially exploded, perspective view of an embodiment of a vehicle suspension.
Figure 3:
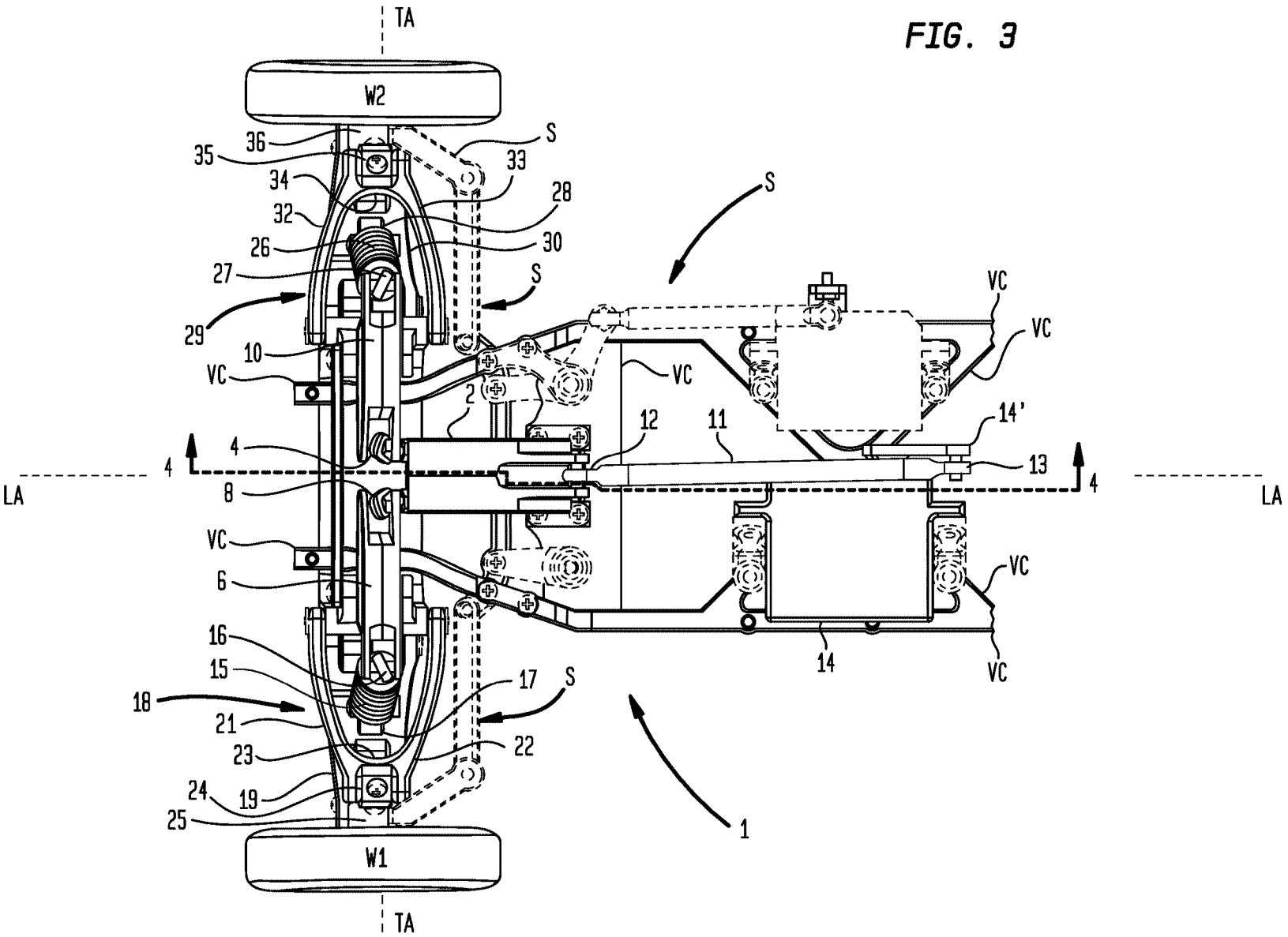
FIG. 3 is a top view of an embodiment of a vehicle suspension.

Now, referring primarily to FIGS. 1 through 3, embodiments of the vehicle suspension (1) can include a first vertical suspension assembly (18) pivotally coupled to the vehicle chassis (VC). The first vertical suspension assembly (18) interconnects a first wheel (W1) to the first adjustable-length member (15) allowing generally vertical movement of the first wheel (W1) in relation to the vehicle chassis (VC). In particular embodiments, the first vertical suspension assembly (18) can include a lower suspension linkage (19) extending from a pivotal coupling on the vehicle chassis (VC) to connect with the second mount (17) of the first adjustable-length member (15), and a first upper wishbone linkage (20) having a first arm (21) and a second arm (22) extending in general parallel relationship to one another (21, 22) from corresponding pivotal couplings on the vehicle chassis (VC) to a first knuckle (23). The first wishbone linkage (20) disposed above the first lower suspension linkage (19), aligns the first mount (16) of the first adjustable-length member (15) connected to the first bell crank (6) with the second mount (17) of the first adjustable-length member (15) connected to the first lower suspension linkage (19) allowing the first adjustable-length member (15) to pass between the first arm (21) and the second arm (22) of the first upper wishbone linkage (20). A first two-ended member (24) can interconnect the first upper wishbone linkage (20) to the first lower suspension linkage (19). A first axle (25) can be rotatably mounted in the first two-ended member (24). The first wheel (W1) can be rotatably coupled to the first axle (25).

Again, referring primarily to FIGS. 1 through 3, the vehicle suspension (1) can further include a second adjustable-length member (26). The second adjustable-length member (26) can have a first mount (27) connected to the second bell crank (10). In substantially similar structural arrangement to the first vertical suspension assembly (18), embodiments can further include, a second vertical suspension assembly (29). The second vertical suspension assembly (29) interconnects a second wheel (W2) to the second adjustable-length member (26). The second vertical suspension assembly (29) can include a second lower suspension linkage (30) connected to a second mount (28) of the second adjustable-length member (26). A second upper wishbone linkage (31) includes a first arm (32) and a second arm (33) which correspondingly extend from pivotal couplings on the vehicle chassis (WC) in a substantially parallel relationship to a second common knuckle (34). The second upper wishbone linkage (31) can be disposed above the second lower suspension linkage (30), to align the first mount (27) of the second adjustable-length member (26) connected to the second bell crank (10) with the second mount (28) of the second adjustable-length member (26) connected to the second lower suspension linkage (30) allowing the second adjustable-length member (26) to pass between the first arm (32) and the second arm (33) of the second upper wishbone linkage (31). The vertical suspension assembly (29) can include a second two-ended member (35) which interconnects the second upper wishbone linkage (31) to the second lower suspension linkage (30). A second axle (36) can be rotatably mounted in the second two-ended member (35). The second wheel (W2) can be rotatably coupled to the second axle (36).

Again, referring primarily to FIGS. 1 through 5, in particular embodiments, the central bell crank (2) can be pivotally mounted on the vehicle chassis (VC) to axially pivot along the longitudinal axis (LA) of the vehicle chassis (VC) interconnecting the connecting rod (11) to the first link (3) and second link (7). The first link (3) and second link (7) can be disposed side-by-side to one another in vertical orientation to connect second ends (5) (9) to the central bell crank (2). Each of the first ends (4), (8) of the first link (3) and the second link (7) can correspondingly couple to the first bell crank (6) and second bell crank (10) each mounted to the vehicle chassis (VC) to transversely pivot across the longitudinal axis (LA) of the vehicle chassis (VC). Operation of the rotary actuator (14) moves the connecting rod (11) to generate operative interconnection between the central bell crank (2), the first bell crank (6) and the second bell cranks (10) to concurrently transfer sufficient force through the first adjustable-length member (15) and the second adjustable-length member (26) to downwardly lower the first vertical suspension assembly (18) and the second vertical suspension assembly (29) in relation to the vehicle chassis (VC) to correspondingly upwardly raise the vehicle chassis (VC) in relation to the support surface (SS). In particular embodiments, the downward movement of the first vertical suspension assembly (18) and the second vertical suspension assembly (29) can occur with sufficient force to cause the first wheel (W1) and the second wheel (W2) to hop off the support surface (SS), whether the vehicle is either stationary or in motion. In particular embodiments, the rotary actuator (14) can be repeatedly actuated to cause a repeated hopping motion of the vehicle chassis (VC) in relation to the support surface (SS).

Now referring primarily to FIGS. 1, 2 and 3, the rotary actuator (14) can, but need not necessarily, have a square center section with opposite extending brackets for mounting to the vehicle chassis (VC). The rotary actuator (14) in operation via radio control, can be connected to an offset actuator horn (14'), which can be connected to a second end (13) of the connecting rod (11). When the rotary actuator (14) actuates the connecting rod (11), the radial movement of the actuator horn (14') can converted into linear movement in the form of a rearward pull of the connecting rod (11).

Figure 4:
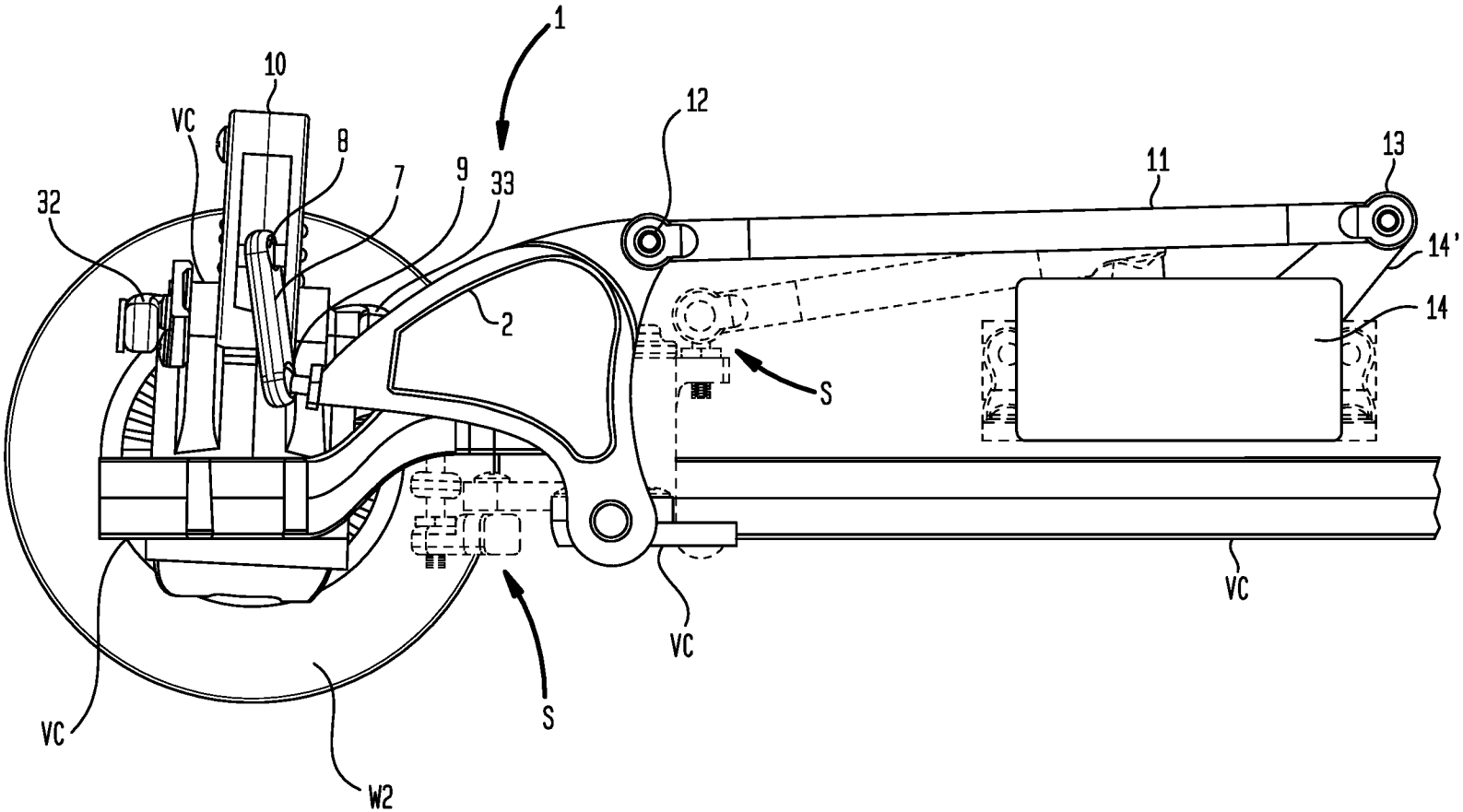
FIG. 4 is a cross-sectional view 4-4 of an embodiment of a vehicle suspension shown in FIG. 3.
Figure 5:
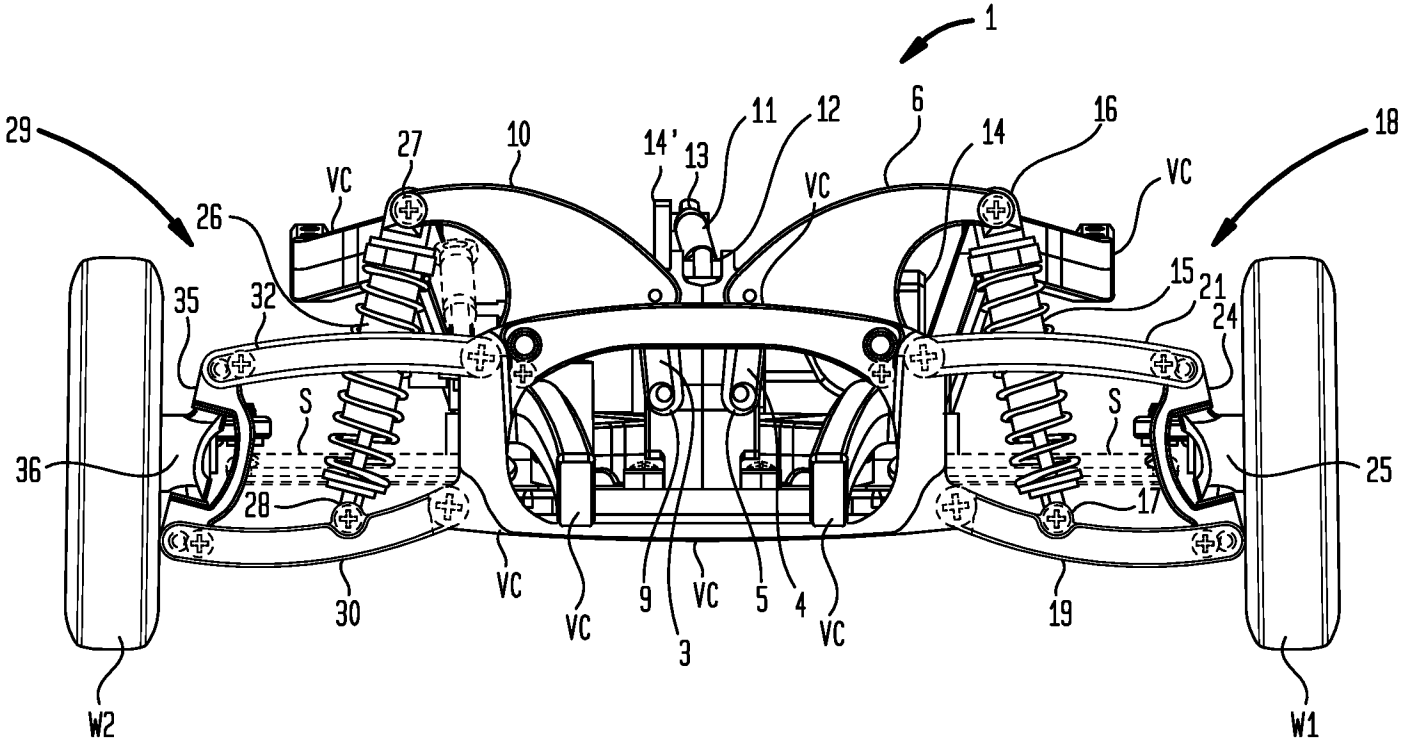
FIG. 5 is a front view of an embodiment of a vehicle suspension.

Now, referring primarily to FIGS. 3 and 4, a steering linkage (S) (shown in broken line) can, but need not necessarily, be operated by a second rotary actuator via radio control.

As can be easily understood from the foregoing, the basic concepts of the present invention may be embodied in a variety of ways. The invention involves numerous and varied embodiments of a vehicle suspension apparatus, a method of making a vehicle suspension, a method of using a vehicle suspension apparatus to make a remote control car hop, and the component parts thereof, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "crank" should be understood to encompass disclosure of the act of "cranking"—whether explicitly discussed or not—and, conversely, were there effectively disclosure of the act of "cranking", such a disclosure should be understood to encompass disclosure of a "crank" and even a "means for cranking." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) the vehicle suspension apparatus disclosed and described, ii) the related methods and systems disclosed and described, iii) similar, equivalent, and even implicit variations of each of the structure and method, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. An apparatus, comprising:

a vehicle having a vehicle chassis;

a central bell crank pivotally mounted in fixed location on said vehicle chassis, said central bell crank has a pivot axis extending laterally across a central longitudinal axis of said vehicle chassis, said central bell crank rotates about said pivot axis extending laterally across said central longitudinal axis of said vehicle chassis and along said central longitudinal axis of said vehicle chassis;

a first bell crank pivotally mounted on said vehicle chassis, said first bell crank has a pivot axis extending longitudinally across a transverse axis of said vehicle chassis said first bell crank rotates about said pivot axis extending longitudinally across said transverse axis of said vehicle chassis and along said transverse axis of said vehicle chassis;

a first link having a first end connected to said first bell crank and a second end connected to said central bell crank;

a first adjustable-length member having a first mount connected to said first bell crank and a second mount connected to a first vertical suspension assembly pivotally coupled to said vehicle chassis, said first vertical suspension assembly interconnects a first wheel to said first adjustable-length member; and a connecting rod having a first end pivotally connected to said central bell crank and a second end pivotally connected to a rotary actuator, wherein operation of said rotary actuator generates linear movement of said connecting rod to generate operative interconnection of the central bell crank, the first bell crank and the first adjustable-length member to move said first vertical suspension assembly.

2. The apparatus of claim 1, wherein said rotary actuator comprises a servo motor.

3. The apparatus of claim 1 wherein said first vertical suspension assembly comprises a first lower suspension linkage connected to a second mount of said first adjustable-length member.

4. The apparatus of claim 3, wherein said first vertical suspension assembly further comprises a first upper wishbone linkage disposed above said first lower suspension linkage, said first upper wishbone linkage having a first arm and a second arm each correspondingly extending outward from a pivotal coupling on said vehicle chassis to a first knuckle.

5. The apparatus of claim 4, wherein said first vertical suspension assembly further comprises:

a first two-ended member interconnecting said first upper wishbone linkage to said first lower suspension linkage; and a first axle rotatably mounted in said two-ended member; said first wheel rotatably coupled to said first axle.

6. The apparatus of claim 1, wherein said first adjustable-length member comprises a first shock absorber.

7. The apparatus of claim 1, further comprising:

a second bell crank pivotally mounted on said vehicle chassis, said second bell crank mounted to transversely pivot along a transverse axis across the longitudinal axis of said vehicle chassis; and a second link having a first end connected to said second bell crank and a second end connected to said central bell crank, a second adjustable-length member having a first mount connected to said second bell crank and a second mount connected to a second vertical suspension assembly pivotally coupled to said vehicle chassis, said second vertical suspension assembly interconnects a second wheel to said second adjustable-length member.

8. The apparatus of claim 7, wherein said second vertical suspension assembly comprises a second lower suspension linkage connected to a second mount of said second adjustable-length member.

9. The apparatus of claim 8, wherein said second vertical suspension assembly further comprises a second upper wishbone linkage having a first arm and a second arm each correspondingly extending outward from a pivotal coupling on said vehicle chassis to a second knuckle.

10. The apparatus of claim 9, wherein said second vertical suspension assembly further comprises:

a second two-ended member interconnecting said second upper wishbone linkage to said second lower suspension linkage; and a second axle rotatably engaged in said second, two-ended member, said second wheel rotatably coupled to said second axle.

11. The apparatus of claim 10, wherein a pull force generated from an operative interconnection between said central bell crank and said rotary actuator causes said first wheel and said second wheel to dependently move downward.

12. The apparatus of claim 10, wherein a push force generated from an operative interconnection between said central bell crank and said rotary actuator causes said first wheel and said second wheel to dependently move upward.

13. The apparatus of claim 7, wherein said second adjustable-length member comprises a second shock absorber.

14. The apparatus of claim 13, wherein said rotary actuator is operated by a radio control.

15. The apparatus of claim 1, wherein said vehicle comprises a radio control vehicle.

* * * * *